US007350470B1

(12) United States Patent
Stuhlbarg et al.

(10) Patent No.: US 7,350,470 B1
(45) Date of Patent: Apr. 1, 2008

(54) PLASTIC SAFE WITH CONCEALED HINGE

(75) Inventors: Mort Stuhlbarg, Rancho Dominguez, CA (US); Leslie Chow, Kowloon (HK)

(73) Assignee: Stuhlbarg International Sales Company, Rancho Domingues, CA (US)

( * ) Notice: Subject to any disclaimer, the term of this patent is extended or adjusted under 35 U.S.C. 154(b) by 0 days.

(21) Appl. No.: 11/593,847

(22) Filed: Nov. 7, 2006

(51) Int. Cl.
*E06B 3/34* (2006.01)

(52) U.S. Cl. ..... 109/73; 109/74; 312/329

(58) Field of Classification Search ..... 109/73, 109/74, 77, 64; 16/231, 232, 258; 312/326, 312/329

See application file for complete search history.

(56) References Cited

U.S. PATENT DOCUMENTS 1,425,995 A * 8/1922 McGiveney ..... 16/229
1,436,925 A * 11/1922 Wege et al. ..... 70/82
3,375,546 A * 4/1968 Peterson ..... 16/258
4,258,632 A * 3/1981 LaPointe ..... 109/59 R
4,354,367 A * 10/1982 Wahl ..... 70/333 A
4,398,470 A * 8/1983 Williams et al. ..... 109/52
4,466,676 A * 8/1984 Nilsson ..... 312/283
4,541,545 A * 9/1985 Beattie et al. ..... 220/560.01
4,685,402 A * 8/1987 Nelson et al. ..... 109/65
5,069,358 A * 12/1991 Avery, Jr. ..... 220/560.01
5,152,231 A * 10/1992 Preston et al. ..... 109/65
5,201,867 A * 4/1993 Morszeck ..... 206/316.2
5,357,652 A * 10/1994 Yamada ..... 16/232
5,544,595 A * 8/1996 Stephenson et al. ..... 109/74
5,769,006 A * 6/1998 Allaer ..... 109/73
5,926,916 A * 7/1999 Lee et al. ..... 16/230
5,971,515 A * 10/1999 Baker et al. ..... 312/329
6,257,154 B1 * 7/2001 Kasper ..... 109/73
6,359,547 B1 * 3/2002 Denison et al. ..... 340/5.73
6,736,473 B2 * 5/2004 Cleveland et al. ..... 312/409
6,752,092 B2 * 6/2004 Beattie et al. ..... 109/75

* cited by examiner

*Primary Examiner*—Lloyd A. Gall
(74) *Attorney, Agent, or Firm*—Gary M. Anderson, Esq; Fulwider Patton LLP

(57) ABSTRACT

A plastic safe box has a housing formed of connected panels defining an interior space, and a pivoting door supported on a hinge member integrally formed with said pivoting door. The hinge member receives a support rod mounted inside the safe such that the hinge member is not exposed when the safe is closed. The hinge member is shaped to coincide with the adjoining side panel and door outer surfaces to hide the hinge and conceal the operational hinge components. The hinge member further includes a rounded inner surface that emerges internally as the safe door opens, where the rounded surface is circular with a center coincident with the support rod such that the hinge member follows a circular path as the safe door opens.

7 Claims, 10 Drawing Sheets

PLASTIC SAFE WITH CONCEALED HINGE

BACKGROUND OF THE INVENTION

Stand alone safe boxes (also known simply as "safes") that protect documents, currency, and valuables from fire and theft are now common in most businesses and many homes as well. Safes typically are constructed of a thick metal plates that form an inner compartment for housing the valuables. A door provides access to the inner compartment and a locking mechanism secures the door to the housing to prevent unauthorized entry into the safe interior. The locking mechanism is typically retaining rods that project from the door along inner surfaces into apertures on adjoining surfaces or vice versa. The rods may be maneuvered mechanically, hydraulically, electrically, or by other means, but are traditionally policed by a security mechanism built into the safe door. The security mechanism may be triggered by a numeric or alphanumeric code, a magnetic strip, a simple key, or any other means for storing a code or combination. The triggering device, such as a key or combination, permits the retaining rods to be withdrawn from the outside of the safe via a handle, thereby allowing access to the safe's interior. Safes come in many sizes and shapes, including floor safes, wall safes, stand-alone safes, and variations thereof.

One essential feature of a safe for many businesses and home security purposes is that the safe be capable of protecting its contents in the event of a fire. Because of the intense heat generated in a home or business fire, however, the specifications required to certify a safe for an hour in a standard fire are rigorous and tend to yield safes constructed of steel or lead to withstand the high temperatures. Safes tend to resemble thick-walled boxes of limited physical appeal as function dictates design over form. The thick walls are needed, however, to protect the contents of the safe although this also led to heavy, unwieldy device. The weight characteristics of many safes limited the practical size that these safes could reasonably be constructed for home and small business use since these devices may need to be moved from time to time. Because consumers are always looking for bigger and lighter safes having a more pleasing appearance, the prior art did not satisfy customer demand to its fullest extent.

One of the most important feature of a safe that customers look for is its resistance to break-in. Because valuables and other important documents are traditionally stored in safes, they are always targets for thieves who try to pilfer the safe's contents. The very nature of the safe's construction, namely five walls and a door, emphasize the achilles heel of most safes is the juncture of the door with the adjoining walls. In particular, a would be thief who is without the access code required to open the safe without disabling it will tend not to attempt to penetrate the fixed walls. Rather, access can most easily be obtained by disabling an exposed hinge or coupling that connects the safe door to the housing. Because hinges are outside the safe and can be mechanically, chemically, or thermally disabled, the hinge is the focus of most safe break-ins. This is frustrating to safe owners and builders, who take great measures to provide sturdy, impenetrable walls and yet the strongest of safes can be defeated by simply disengaging the associated hinge member.

Unfortunately, in traditional safe design the hinge is positioned on the exterior of the safe and therefore exposed to mechanical or blunt force that can damage the hinge. In this way, thieves can often defeat the safe's theft protection characteristics by attacking the hinge which in turn allows the thief to gain access to the contents of the safe. The exposure of the safe door hinge prevents most prior art safes from being completely effective against break-in. The present inventor sought to eliminate the aforementioned shortcomings by using a unique plastic safe design that includes a concealed hinge and therefore resists exposure to break-in via the hinge-housing coupling.

SUMMARY OF THE INVENTION

The present invention is a safe constructed of a plastic such as acrylonitrile butadiene styrene (ABS) forming a housing that includes a left and right wall, a back wall, a top and bottom wall, and a pivoting door. The pivoting door is mounted to the housing an integral hinge housing that shields the hinge mechanism from would-be thieves. The hinge housing is formed as part of the safe door and includes first and second intersecting planar surfaces forming the exterior portion of the safe hinge, said planar surfaces are parallel and co-planar with the front surfaces of the pivoting door and right wall, respectively, to form a substantially uninterrupted outer surface of the safe. Opposite the first and second intersecting surfaces, the hinge may be formed with a cylindrical surface extending substantially along an arc between the first and second planar surfaces. The first and second planar surfaces and the cooperating cylindrical surface enclose spring loaded rods that extend from the hinge housing so as to be received by designated holes on the inside of the safe to retain the safe door and permit relative swinging of the door between an open and closed position.

In a first preferred embodiment of the safe, the safe includes a rubber gasket that seals the safe from water and moisture. The need for a water resistance is particularly important in the event of fire, since water may be sprayed on or near the safe to extinguish the fire. In said first preferred embodiment the safe is UL certified to one hour fire resistance, class 350. The safe may include either mechanical or electrical security controls to operate and regulate the safe.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
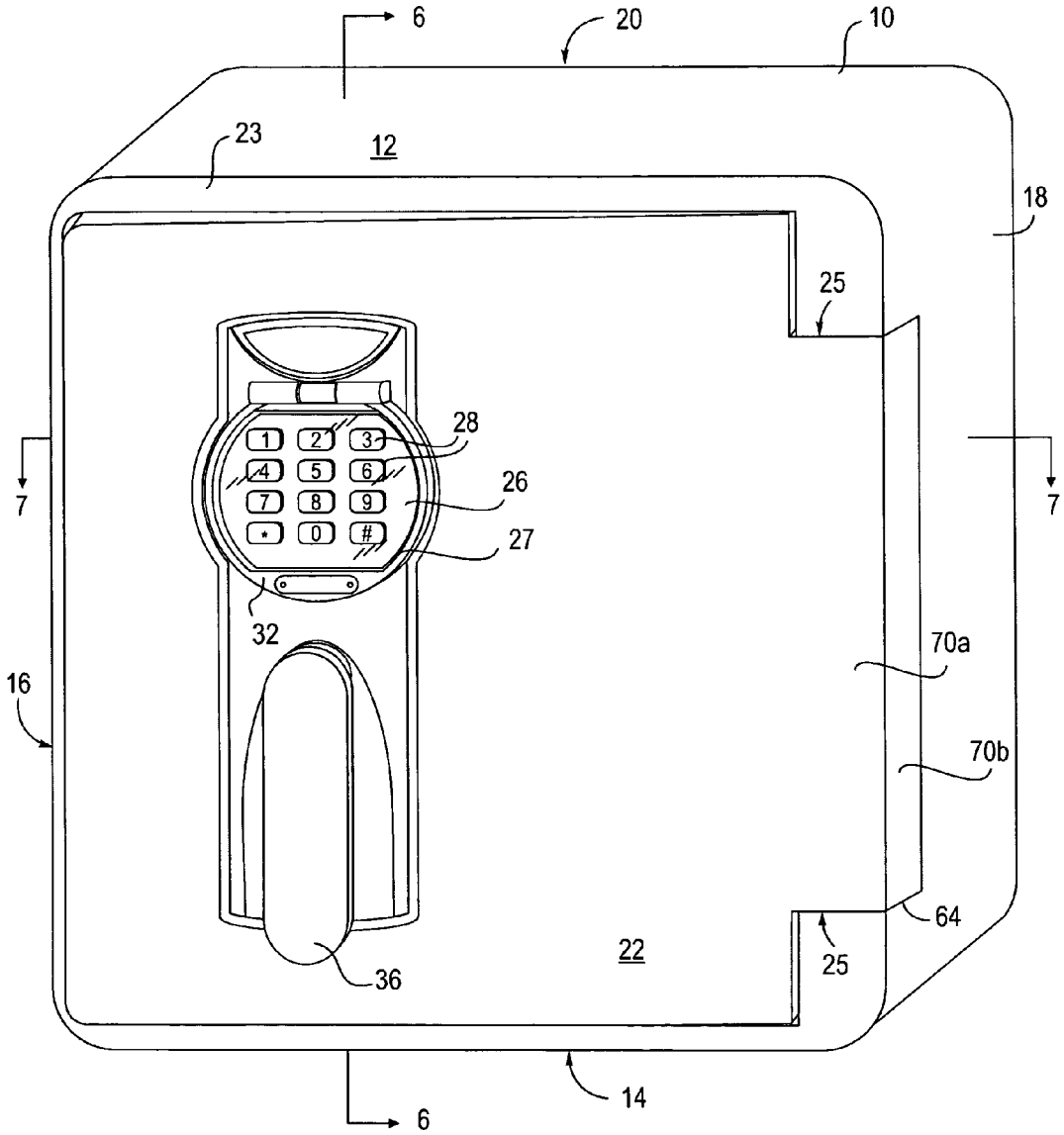
FIG. 1 is an elevated perspective view of a first preferred embodiment of the present invention.
Figure 2:
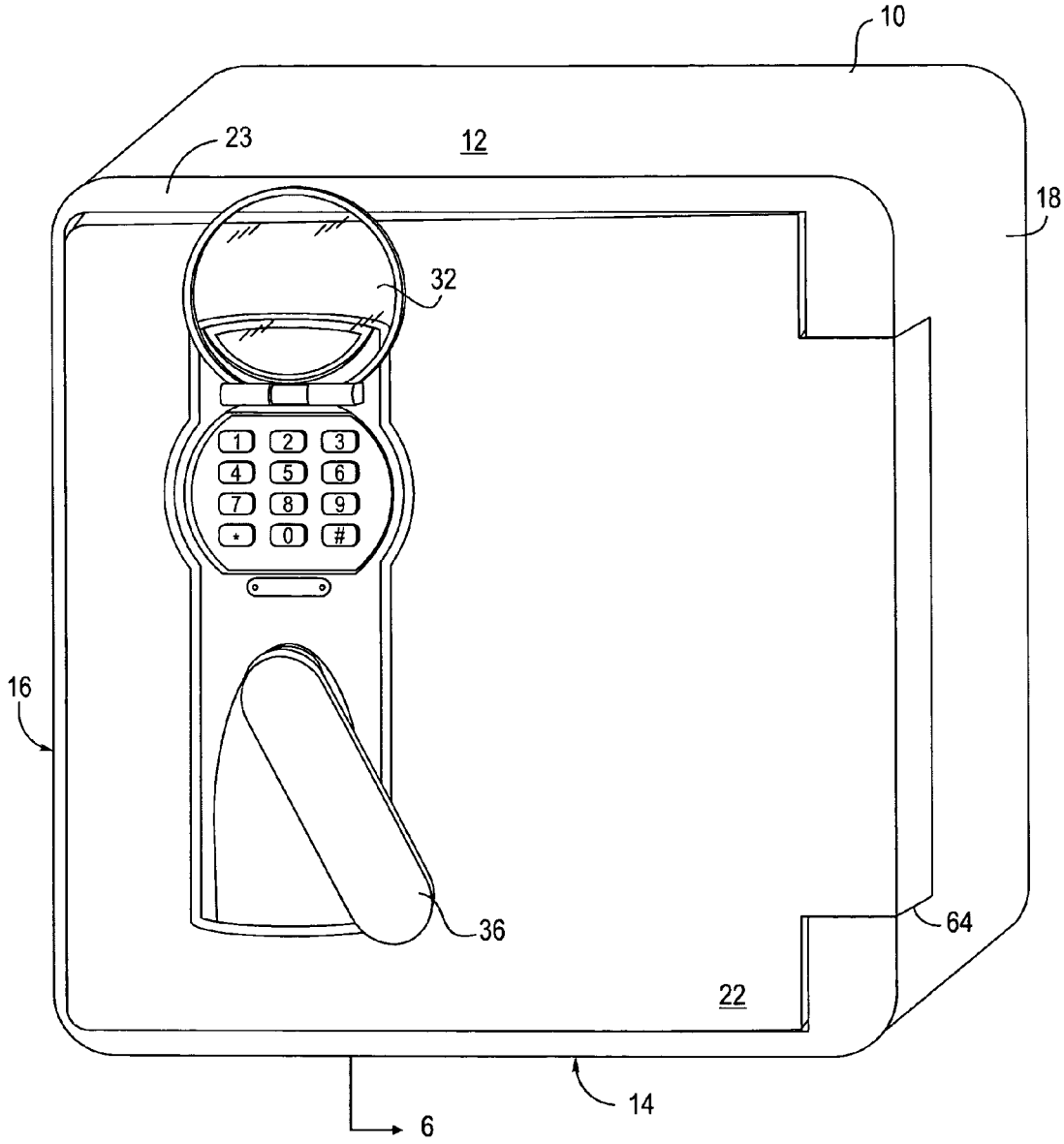
FIG. 2 is an elevated perspective view of the first preferred embodiment of the present invention with the protective cover up and the handle actuated.
Figure 3:
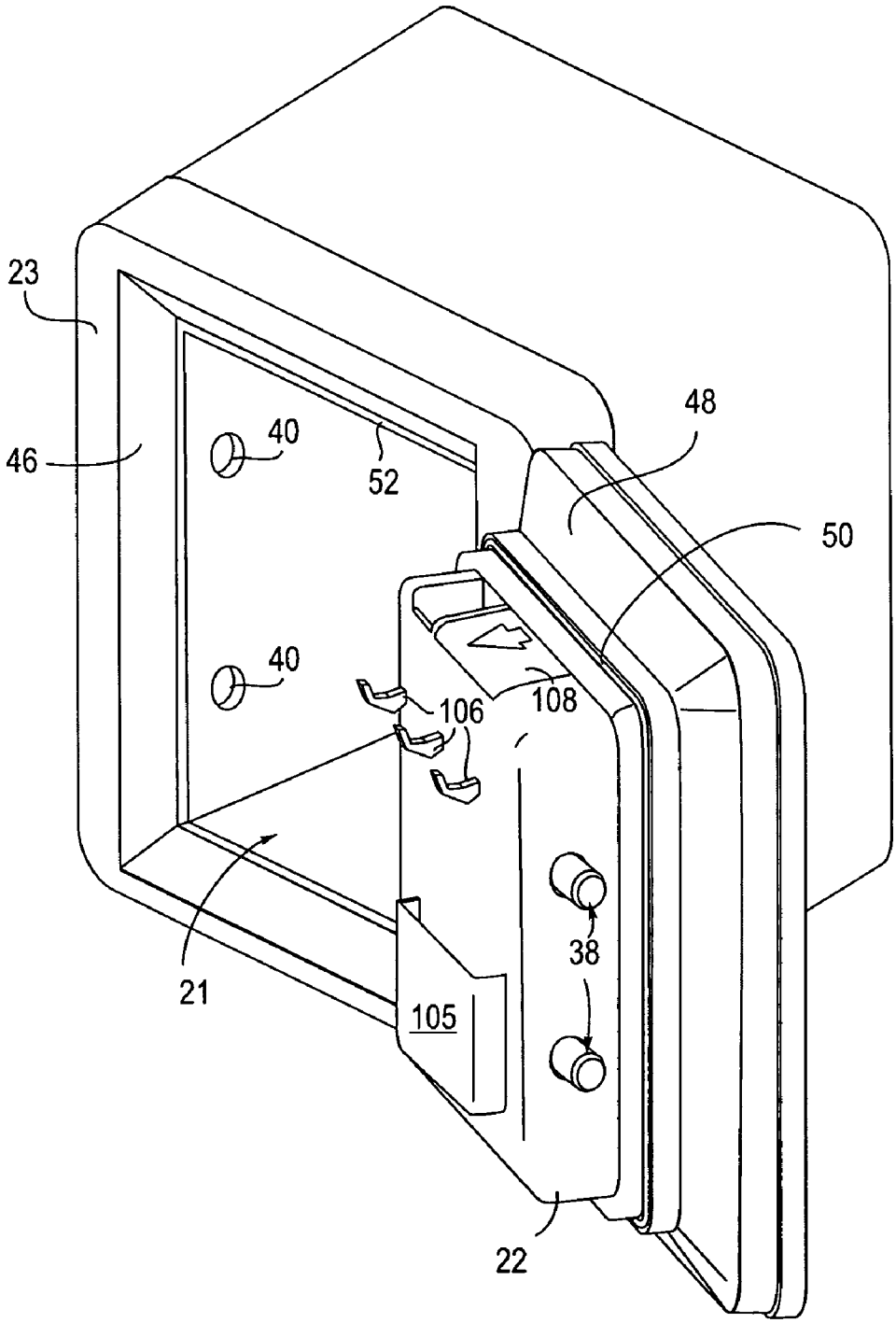
FIG. 3 is an elevated perspective view of the embodiment of FIG. 1 with the door ajar exposing the locking mechanism.

For a better understanding of the present invention together with other and further objects, advantages and capabilities thereof, reference is made to the following disclosure and appended claims in connection with the above described drawings. FIGS. 1-3 illustrate a first embodiment of the present invention characterized by a cubic, stand alone plastic waterproof safe 10 having a top wall 12, a bottom wall 14, a left wall 16, a right wall 18, a back wall 20, and a swinging front door 22. The left wall 16, top wall 12, right wall 18, and bottom wall 14 form at respective front edges an opening 21 into the compartment 24. The opening 21 is bordered by a continuous trim 23 that spans the length of the top, left, and right walls, and abuts the swinging front door 22 at a location 25 vertically spaced from the top and bottom walls.

The safe 10 is provided with a security mechanism 26 for gaining entry to the safe's interior. The security mechanism 26 can be an electronic touch-pad 27 having push buttons 28 coupled to pressure sensitive switches 29 behind said push buttons 28. The pressure sensitive switches 29 are connected to electrical relays and wires that connect the switches to a circuit board 100, and allow a user to enter a numeric or alphanumeric code by pressing a sequence of push buttons on the touch pad 27 having a character designation on the front face. The sequence of buttons can be stored in the read only memory (ROM) of the circuit board 100 and compared with a predetermined access code, and the circuit board 100 sends a signal to an actuator 101 to disengage the retaining rods 38 and unlock the front door 22 if the entered code matches the predetermined access code. Alternately, a manual combination lock can be used. An example of a touch pad actuated safe is Sisco's Honeywell Safe Model Number 2077D offered by the assignee of the present invention.

The typical manual combination lock has a combination dial that is attached to a spindle. Inside the lock, the spindle runs through several wheels and a drive cam. The number of wheels in a wheel pack is determined by how many numbers are in the combination—one wheel for each number. When you turn the dial, the spindle turns the drive cam. As the cam turns, drive pins make contact with a small tab on a wheel fly. Each wheel has a wheel fly on each of its sides. A drive pin spins the first wheel until it makes contact with the wheel adjacent to it, which continues until all the wheels are spinning. Each wheel on the spindle has a notch cut into it, and when the right combination is dialed all the wheels and their notches line up perfectly. A small metal bar attached to a lever, called a "fence", prevents the safe door from being opened without the combination being dialed. It does this by resting on the wheels and blocking the path of the bolt that secures the safe door. When all the wheels line up, their notches align to form a gap. In a safe the fence rests just above the wheels and falls into a gap under the force of its own weight. With the fence gone, the bolt can slide freely past and the safe can be opened. An example of a combination safe is Sisco's Honeywell Safe Model Number 2054. There are other known security mechanisms that can operate with the safe of the present invention to permit access to the safe's interior without departing from the scope of the present invention, including scan and digital biometric security devices.

FIG. 1 shows the touchpad 27 with push buttons 28 arranged in the standard telephone key pad arrangement. The safe 10 is also provided with a pivoting plastic dust cap 32 that pivots under the influence of gravity down over the touchpad 27 to prevent dust and dirt from gathering in the recesses of the push button gaps. The dust cap 32 can be rotated upward and out of the way when a combination is entered on the touchpad 27. The safe 10 further includes a handle 36 that opens the safe 10 once the security mechanism has been actuated as is known in the art. The handle 36 is preferably a lever that rotates only after the security mechanism has determined that the correct access code has been entered. Of course, the handle 36 can take many forms and the particular shape or configuration shown in the drawings plays no part of the present invention.

Figure 9:
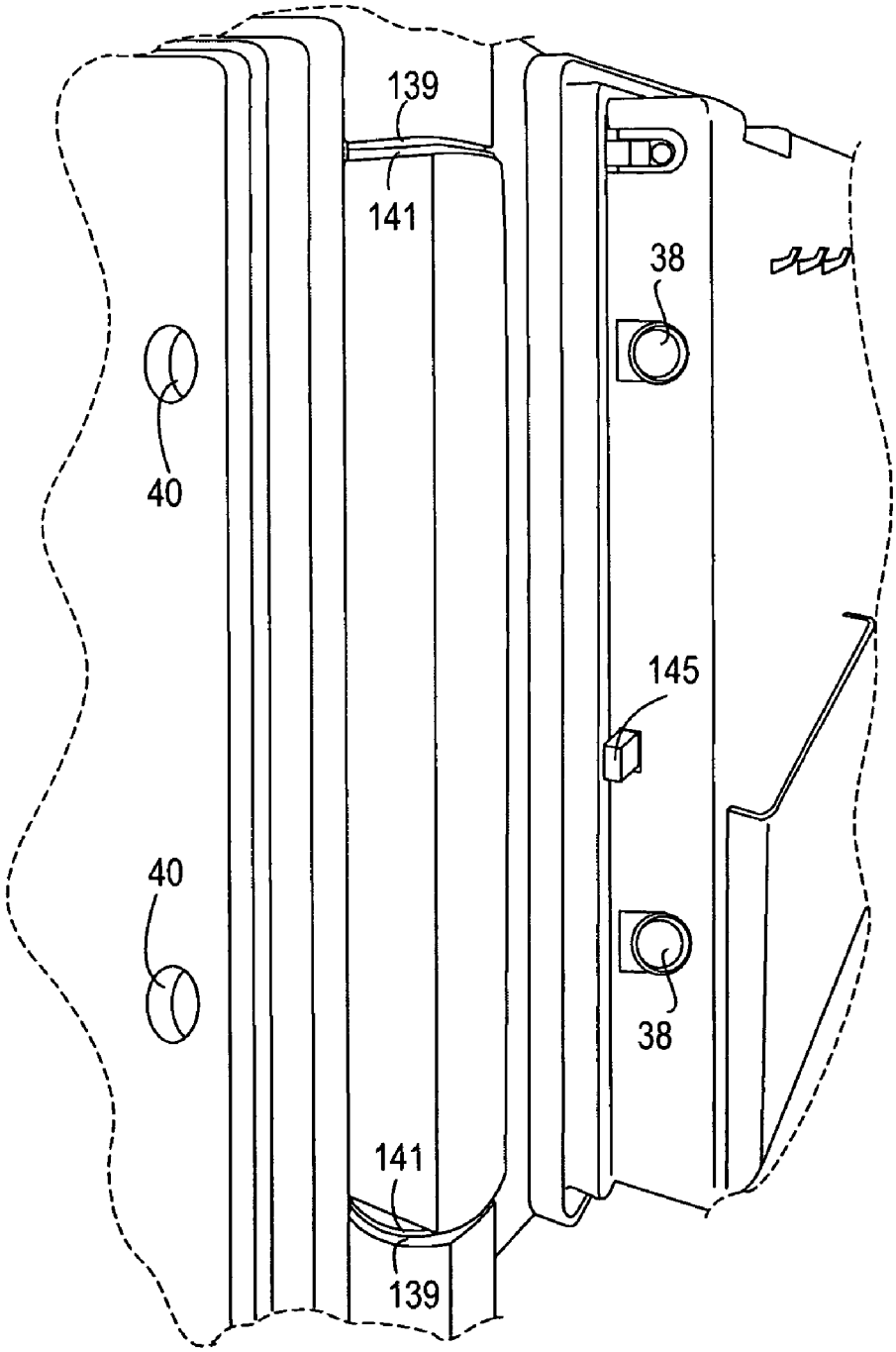
FIG. 9 is an enlarged, elevated view of the hinge element of the embodiment of FIG. 1 with the door partially open.

Rods 38 extending from the swinging front door 22 into reinforced recesses 40 in the left wall 16 and the right wall 18 to secure the door 22 in a closed position are retracted by a lateral movement of the handle 36. FIG. 2 illustrates the flip up position of the dust cap 32 and the actuated position of the handle 36. FIGS. 3 and 9 illustrate the position of the rods 38 projecting from the side of the door 22 and further show the location of the reinforced recesses 40 in the inner surface of the side walls 16,18 of the safe. The mechanism by which the rods are extended and retracted into the adjacent walls of the safe to secure the safe door closed are well known in the field and its description is omitted herein for the sake of brevity.

FIG. 3 illustrates the profile of the door 22 and the complementary shape of the entrance 21 of the safe 10 formed by the trim 23 and the radially inwardly formed shoulder 46, which mates with the recessed rear peripheral surface 48 of the front door 22. In a similar fashion, a horizontally directed first inner step 50 on the door cooperates with a complementary rectangular recess 52 in the entrance to the safe interior. A rubber seal 58 (shown in FIG. 6) is compressed against the rectangular recess 52 of the entrance of the safe to create a water proof seal and smoke barrier between the safe door 22 and the peripheral surfaces surrounding the entrance to the safe interior to protect the contests of the safe from water and smoke damage. The inner surface of the door 22 is provided with a pocket 105 for storing papers and includes several hook members 106 for hanging keys or other objects. On the upper surface of the door 22 is a compartment 108 for housing batteries to power the touchpad 27 in the electronic versions of the present embodiment. Retaining rods 38 are clearly shown in FIG. 3 in their extended position, but said rods are normally retracted when the safe door is open and extended into holes 40 when the safe door is closed to lock the safe from the inside.

Figure 4:
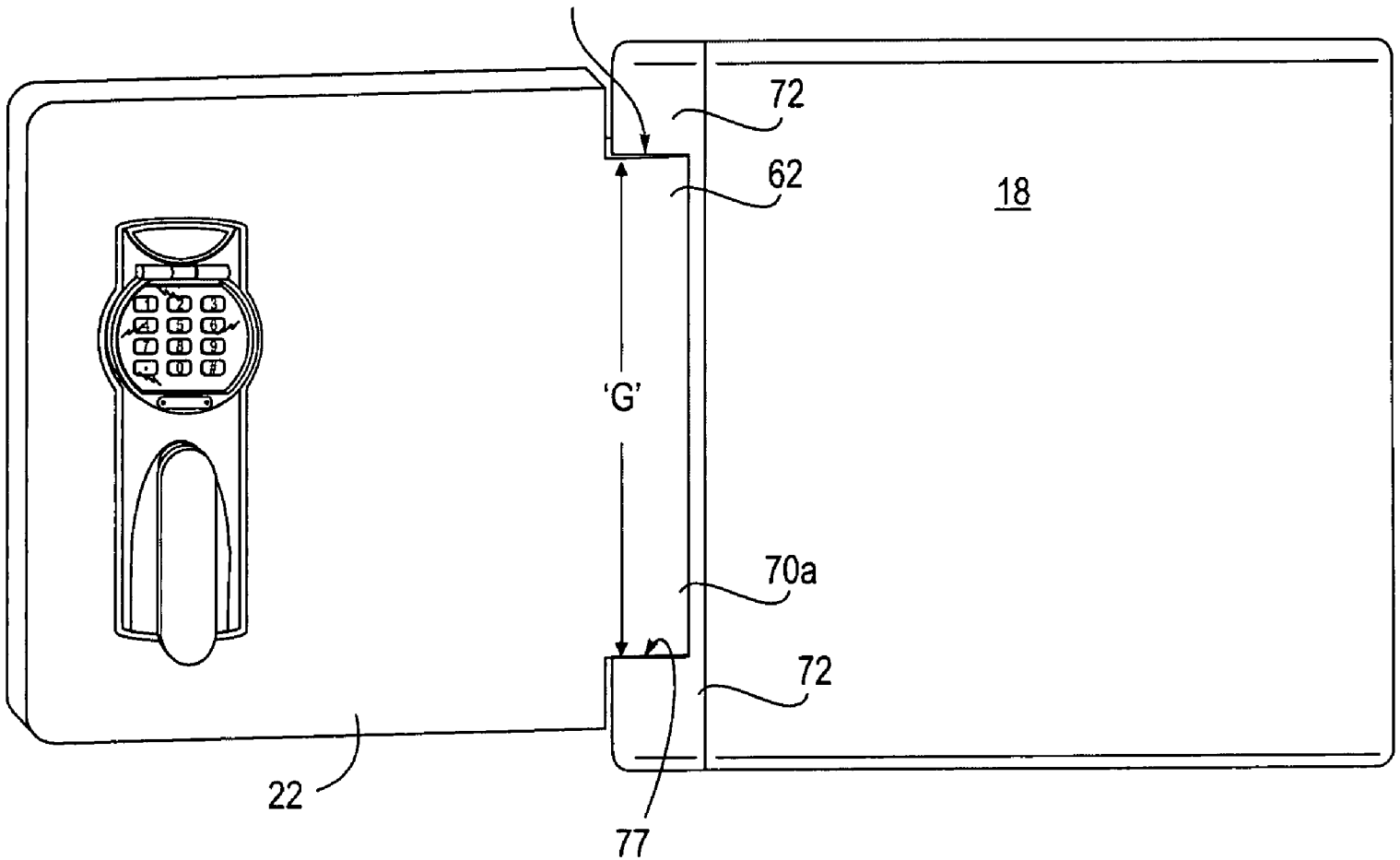
FIG. 4 is a side view of the embodiment of FIG. 1 with the door open and extending ninety degrees from the opening of the safe.
Figure 5:
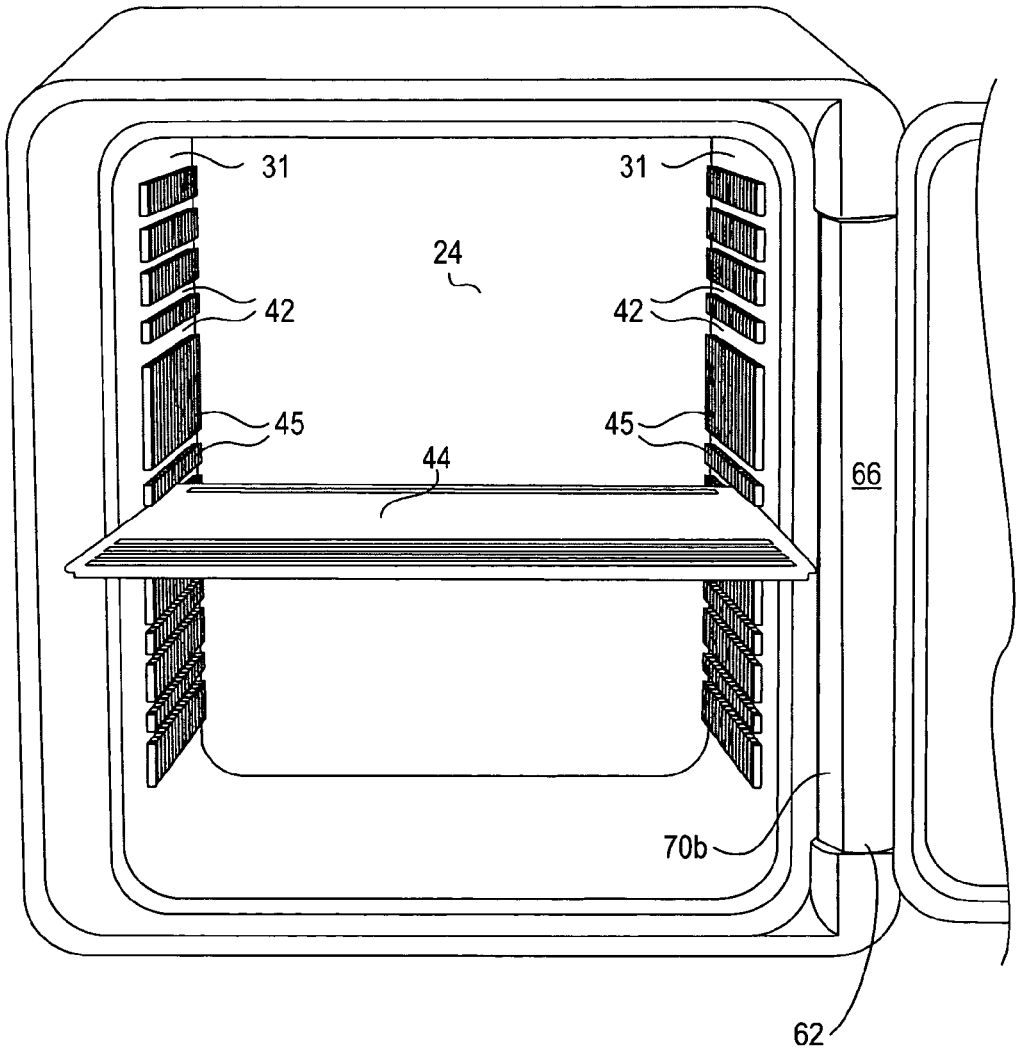
FIG. 5 is a front view of the embodiment of FIG. 1 showing the interior and the inner surface of the hinge element.
Figure 10:
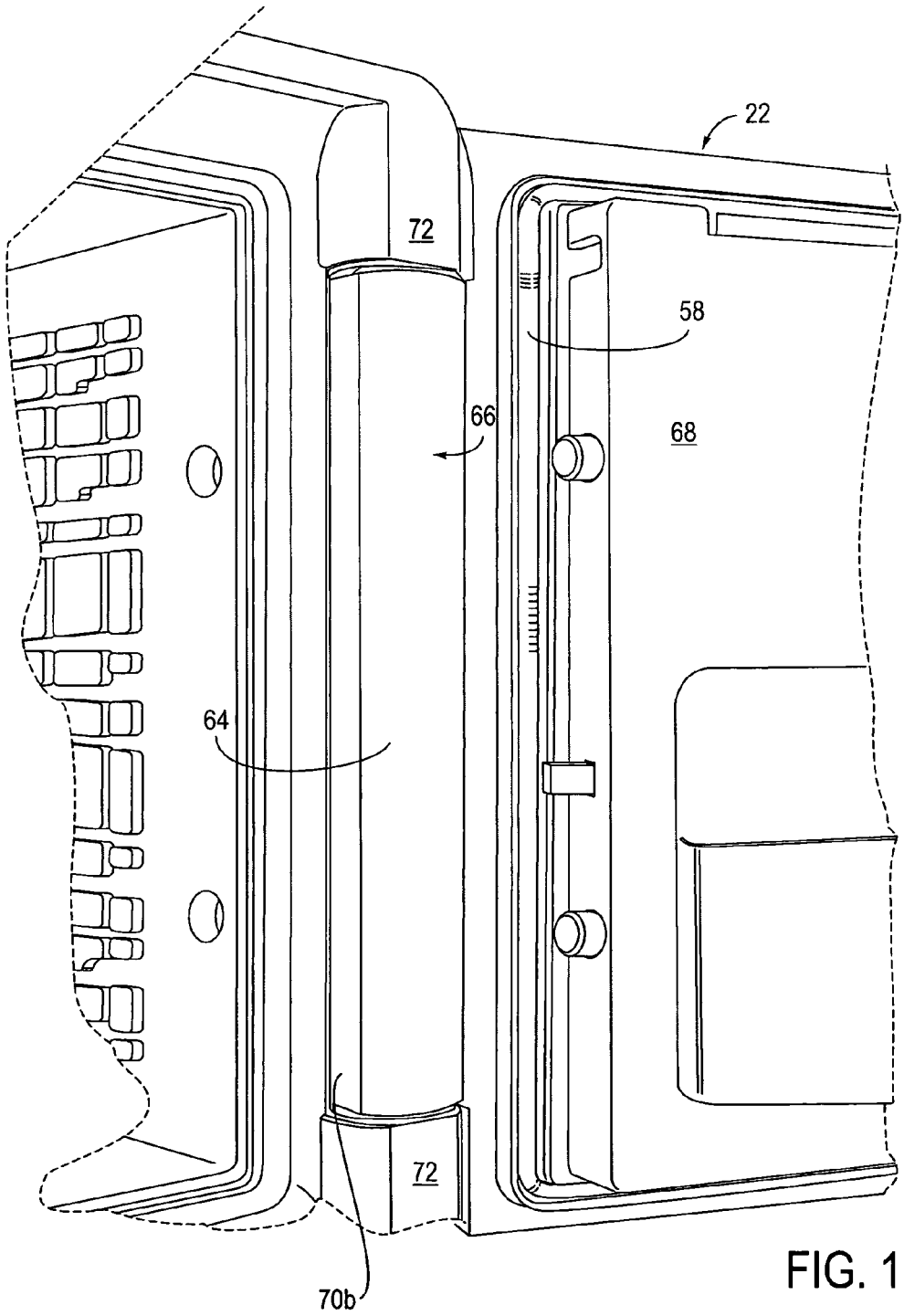
FIG. 10 is another enlarged, elevated view of the hinge element of the embodiment of FIG. 1 from the inside with the door partially open.

FIGS. 1, 4 and 5 illustrate the safe door 22 in both the open and closed positions and the function of the hinge housing 62. The right wall 18 of the safe 10 is formed with upper and lower forward facing projections 72 having opposed parallel inwardly facing surfaces spaced apart by a gap, and front faces defining a common plane coincident with the plane of the safe door 22 when the door is in a closed position. The door 22 is integrally formed with a laterally extending hinge column 62 sized to fit into and be retained with said gap 'G' defined by said inwardly facing surfaces 77 on said forward facing projections 72. The hinge column 62 includes an inner surface 66 (see FIG. 10) having a circular profile along an arc between the juncture of the hinge column 62 with the inner surface of the door 22, and the outer planar surface 70*b*. When the door 22 is swung open the inner surface 66 becomes increasingly exposed and the cylindrical surface ensures that no edges or protrusions extend beyond the radius of the cylindrical portion during the initial opening of the door until the door clears a ninety degree position. This is preferable so that the door will open smoothly without catching or knocking anything on the interior of the safe. Further opening of the door 22 beyond the ninety degree position results in the outer planar surface 70*b* coming into view from the perspective of the inside of the safe as shown in FIG. 10.

Referring back to FIG. 1, the exposed outer surfaces 70*a*,70*b* of the hinge housing 62 is formed with first and second flat faces joined at a right angle to coincide with the exterior surfaces of the vertically extending end portions 72 of the right wall so that there is virtually no discontinuity between the door's front surface and the outer surface of the right wall 18 as seen in FIG. 1. This, along with the integral formation of the hinge housing with the door 22, enables the hinge housing to completely conceal within the safe the pivot support structure so that no portion of the hinge is exposed when the safe is closed. In FIG. 4 with the door opened 90°, the surface 70*a* is flush with the right side wall 18 forming a smooth, uninterrupted surface from the door 22 to the side wall 18. In this manner, all aspects of the hinge are seamlessly concealed and confined to the footprint of the safe with no portion of the hinge extending beyond either the plane defined by the front surface of the door or the plane defined by the outer surface of the side wall.

FIG. 5 further illustrates the inner face 31 of the left and right walls that include grooves 42 formed by rectangular projections 45 that receive a shelf 44 similar to an oven rack in an oven, where the shelf 44 can be moved to different elevations within the safe by sliding out the shelf and reinserting the shelf into a new groove 42. Additional shelves can be added as needed by the user.

Figure 6:
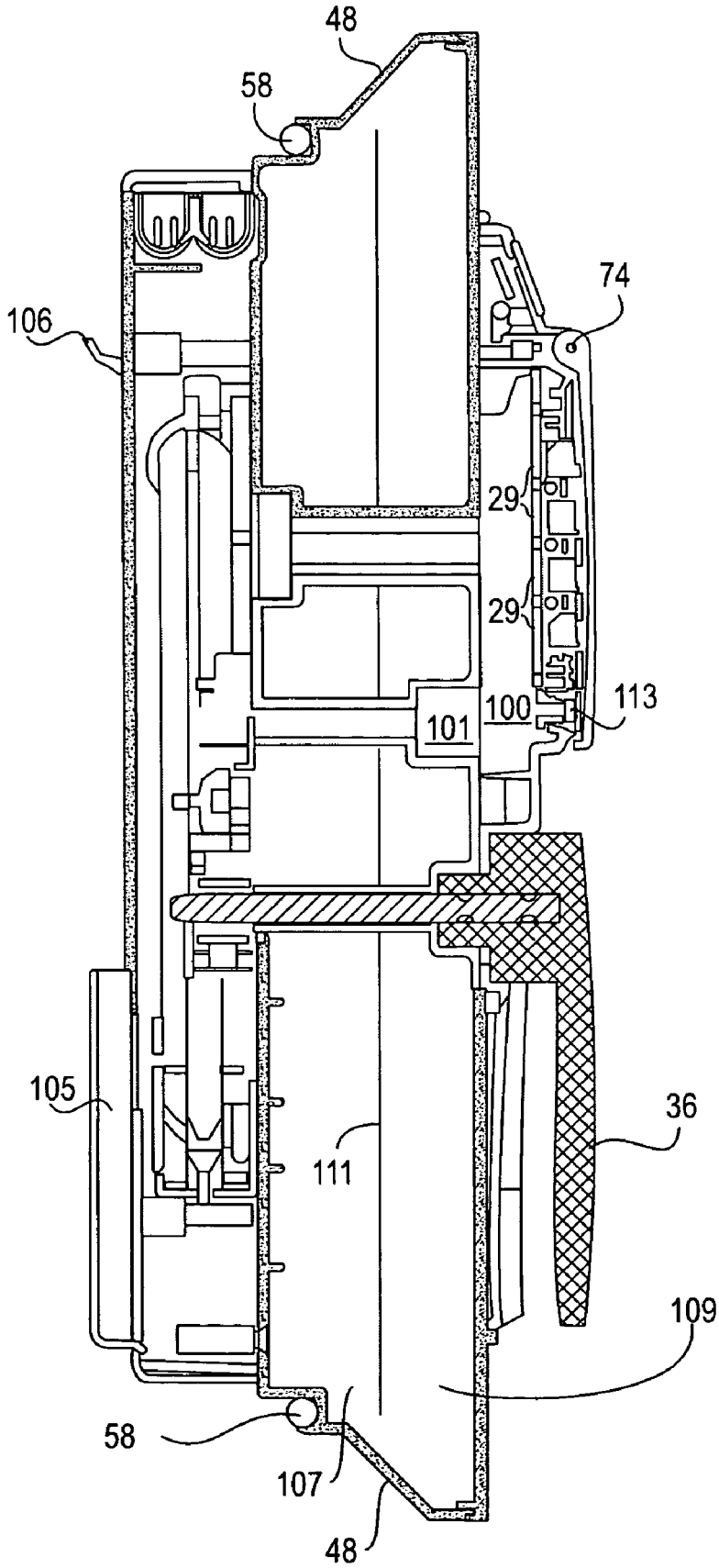
FIG. 6 is a cross-sectional view of the embodiment of FIG. 1 taken along line 6-6.
Figure 7:
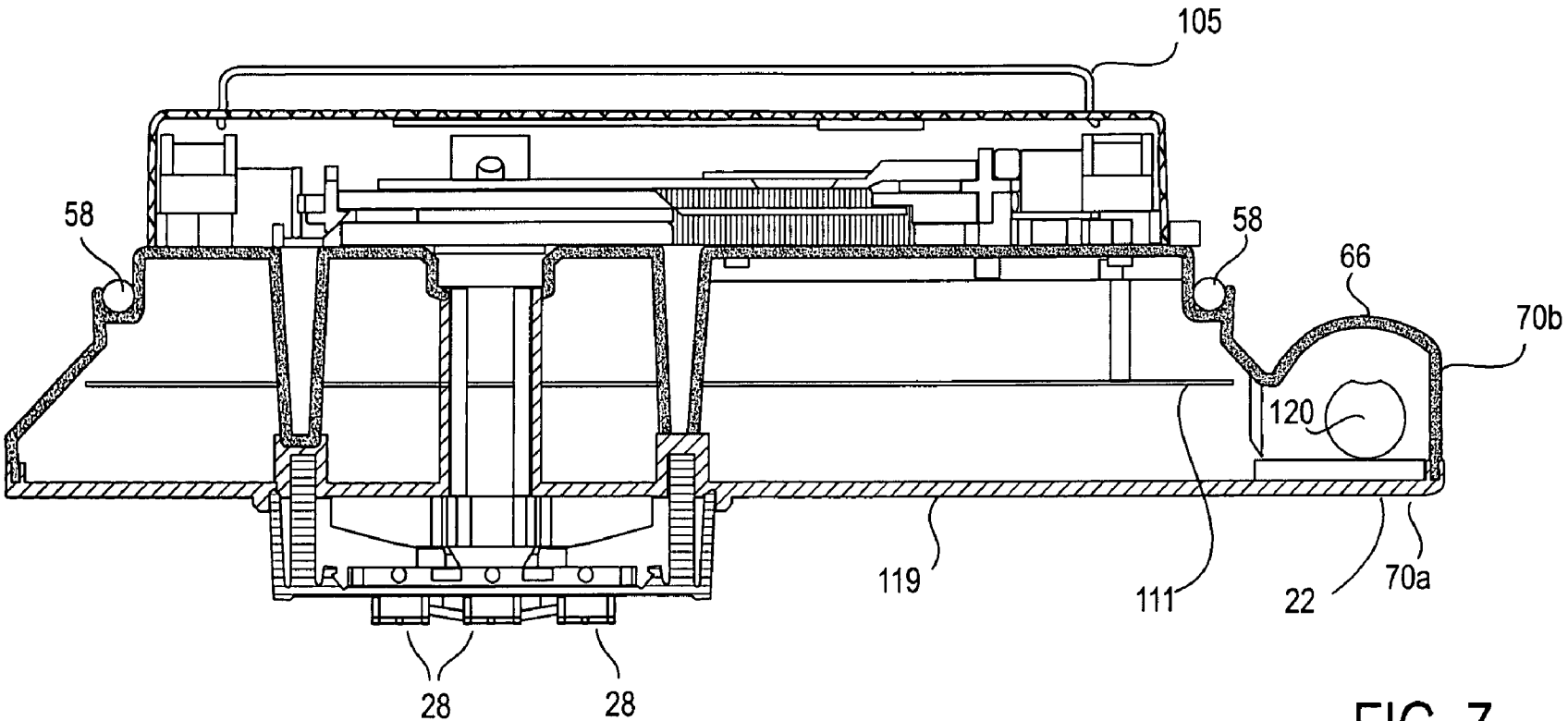
FIG. 7 is a cross-sectional view of the embodiment of FIG. 1 taken along line 7-7.
Figure 8:
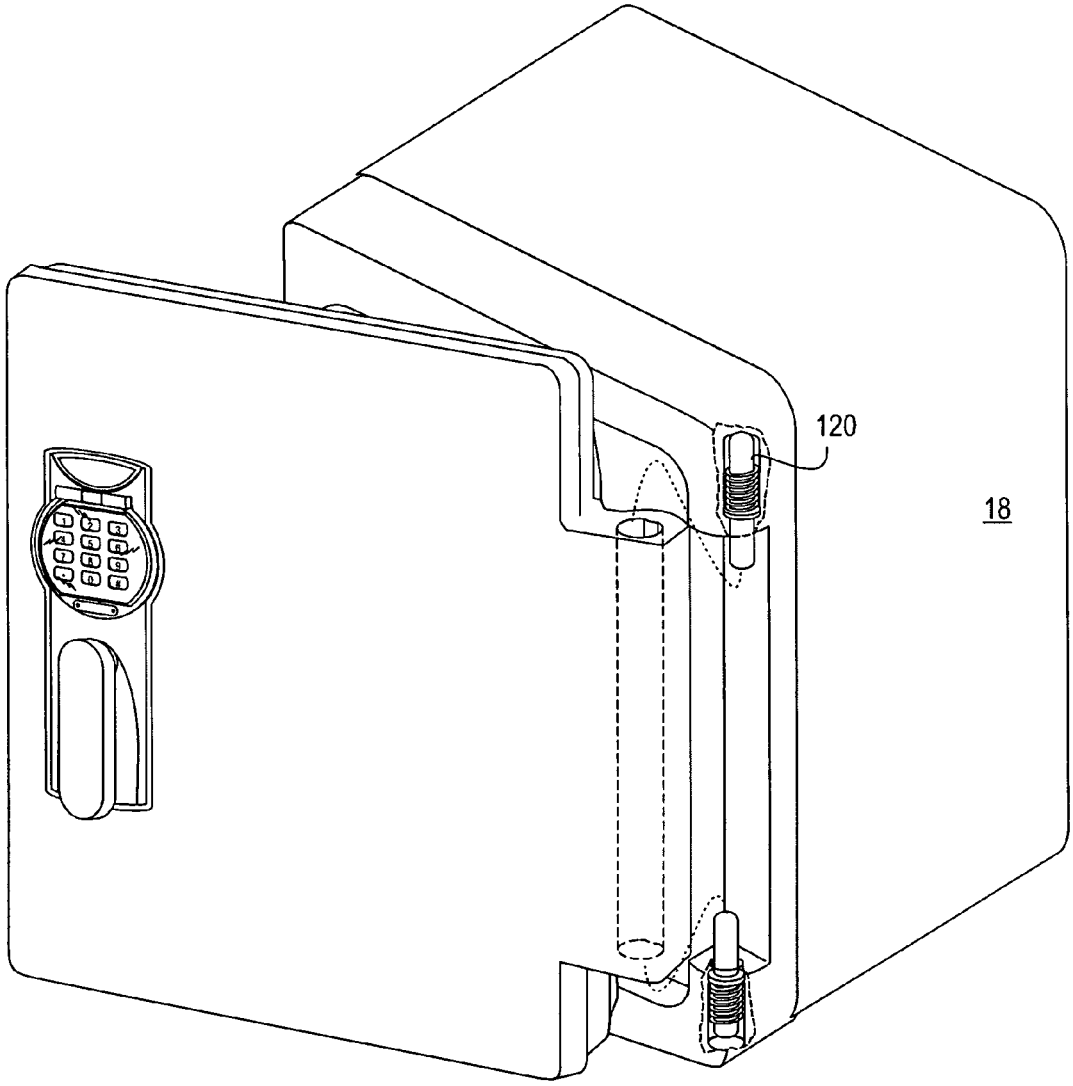
FIG. 8 is an elevated, perspective view partially in shadow of the embodiment of FIG. 1 showing the connection of the safe door to the housing.

FIGS. 6 and 7 are respective cross sectional views of the door 22. In FIG. 6, the key pad is protected by the hinged dust cover that rotates about lynch pin 74 to expose the push buttons 28. The rubber seal 58 is clearly shown as secured inside the groove formed by the recess in the door's profile. The door 22 includes an interior compartment 107 that is filled with a foam insulation 109, where a wire mesh divider 111 runs through the middle plane of the door 22. A data port 113 may also be located on or adjacent to the key pad 27 that links with the security mechanism and can be used to override the touch pad security sequence or the manual combination sequence. That is, should the lock combination become lost or forgotten, the circuit board 100 can be accessed through the data port 113 and the safe opened or reprogrammed with a new code. With respect to FIG. 7, the vertical column that forms the housing of the hidden hinge is shown in profile depicting the first surface 66 of semi-cylindrical contour, and the opposite surfaces formed by two adjacent faces 70*a,b*, the first face 70*a* parallel and coincident with the outer surface 119 of the door 22 and the second face 70*b* parallel and coincident with the outer surface of the right wall 18. Extending vertically from the upper and lower projections 72 are spring actuated pivot rods 120 that are compressed while the hinge column 62 is positioned in the gap 'G', and then released to register in collinear bores (see FIG. 8) in the respective upper and lower surfaces of the hinge housing so as to allow the door 22 to be mounted on the housing and swing open and closed.

FIGS. 9 and 10 are an enlarged views of the inner surface of the hinge as the door 22 begins to open. The surface 70*b* rotates toward the safe's interior as the door swings open, until it reappears (see FIG. 10) on the safe's interior as the door opens up completely. FIG. 9 illustrates two seals or washers 139, 141 between the hinge column and the portions 72 of the right wall 18 that facilitate the swinging of the door without binding. A mechanical sensor 145 can also be included that compresses when the safe door 22 is closed, signaling the circuit board of the status of the door.

An important feature of the present invention is that the safe can be formed of a heat resistant plastic such as, for example, an acrylonitrile-butadiene-styrene (ABS) resin produced by continuous mass (or bulk), suspension or emulsion polymerization. ABS resins are composed of over 50 percent styrene and varying amounts of butadiene and acrylonitrile. The use of a heat resistant plastic such as an ABS resin significantly reduces the weight of the safe without sacrificing significant strength or heat capacity. In a preferred embodiment, the ABS resin is ABS Porene GA850, a high impact high gloss ABS with superior heat and melt characteristics and desirable strength under both nominal and high temperature environments. The following chart shows the characteristics of ABS Porene GA850.

Article I. TPI Porene ® Grade ABS-GA850 High Impact ABS Resin
Subcategory: ABS Polymer; Polymer; Thermoplastic

| | Metric | English | Comments |
|---|---|---|---|
| Physical Properties | | | |
| Density | 1.05 g/cc | 0.0379 lb/in$^3$ | ASTM D792 |
| Melt Flow | 20 g/10 min | 20 g/10 min | 220° C./10 kg |
| Mechanical Properties | | | |
| Hardness, Rockwell R | 118 | 118 | ASTM D785 |
| Tensile Strength, Yield | 51.7 MPa | 7500 psi | at ⅛ in (3.2 mm). |
| Flexural Modulus | 2.34 GPa | 339 ksi | at ⅛ in (3.2 mm). |
| Flexural Yield Strength | 70.3 MPa | 10200 psi | at ⅛ in (3.2 mm). |
| Izod Impact, Notched | 2.67 J/cm | 5 ft-lb/in | at 6.4 mm (¼ in). |
| Izod Impact, Notched | 2.99 J/cm | 5.6 ft-lb/in | at 3.2 mm (⅛ in). |
| Thermal Properties | | | |
| Maximum Service Temperature, Air | 87° C. | 189° F. | Deflection Temp |
| Deflection Temperature at 0.46 MPa (66 psi) | 96° C. | 205° F. | ASTM D648 |
| Deflection Temperature at 1.8 MPa (264 psi) | 87° C. | 189° F. | ASTM D648 |

-continued

| Article I. TPI Porene ® Grade ABS-GA850 High Impact ABS Resin<br>Subcategory: ABS Polymer; Polymer; Thermoplastic | | | |
|---|---|---|---|
| | Metric | English | Comments |
| Flammability, UL94* | HB | HB | 1/16 in (1.6 mm) |
| Flammability, UL94* | HB | HB | 1/8 in (3.2 mm) |
| Processing Properties | | | |
| Rear Barrel Temperature | 193° C. | 380° F. | |
| Middle Barrel Temperature | 216° C. | 420° F. | |
| Front Barrel Temperature | 232° C. | 450° F. | |
| Melt Temperature | 218-260° C. | 425-500° F. | Nozzle temp not greater than stock |
| Mold Temperature | 48.9-65.6° C. | 120-150° F. | |
| Drying Temperature | 87.8-93.3° C. | 190-200° F. | |
| Dry Time | 2-24 hour | 2-24 hour | |
| Injection Pressure | 68.9-82.7 MPa | 10000-12000 psi | |
| Back Pressure | 0.689 MPa | 100 psi | |
| Screw Speed | 50-60 rpm | 50-60 rpm | |

Using the aforementioned ABS plastic, the present invention has achieved Underwriters Laboratories certification for class 350—1 Hour Fire Resistance. The present design has also been found to prevent the introduction of water even after being submerged for twelve hours in a tank.

The features of the present invention demonstrate a light weight fire proof and water proof safe that incorporates a hinge mechanism substantially concealed and shielded from access while the safe is closed. The nature of the hidden hinge prevents tampering or vandalism to the hinge. The insulation in the plastic compartments that form the respective side, top, bottom, and front and rear walls protect the contents of the safe from heat damage even if the exterior of the safe suffers damage. While the drawings and description of the safe feature specific embodiments, the scope of the present invention is not intended to be limited by said embodiments, but rather one of ordinary skill in the art will readily appreciate modifications to the disclosed embodiments that should be included in the scope of the invention. Accordingly, the metes and bounds of the invention are properly governed in accordance with the foregoing description but limited only by the ordinary words and terms of the appended claims.

We claim:

1. A safe having a top panel, right and left side panels, a bottom panel and a rear panel defining a housing having an internal compartment, and a pivoting door coupled to a selected one of said right and left side panels to secure the internal compartment, said safe further comprising:

a security mechanism for releasably locking the pivoting door to the housing;

a handle for moving said pivoting door between a closed position and an open position;

first and second vertically aligned, vertically oriented spaced apart spring actuated pivot rods embedded in one of said side panels, said one of said side panels having a columnar recess at a front edge and said first and second vertically aligned, vertically oriented spaced apart spring actuated pivot rods having opposed ends that project from an embedded position into said columnar recess;

a laterally protruding lug integrally projecting from a lateral edge of said pivoting door, said lug received in said columnar recess and having first and second openings in respective upper and lower surfaces, each opening arranged to capture one of said opposed ends of the pivot rods such that said pivoting door is supported by and pivots about said pivot rods; and said lug comprising a planar front surface coplanar with a front planar surface of said pivoting door, a planar side surface orthogonal to said planar front surface and coplanar with said one of said side panels when the pivoting door is closed, and an arced rear surface integrally connected to an inner surface of said pivoting door.

2. The safe of claim 1 wherein said security mechanism includes an electronic key pad.

3. The safe of claim 2 including an override port for bypassing said security mechanism.

4. The safe of claim 1 including a plurality of vertically spaced apart grooves on internal surfaces of said right and left side panels for securing a removable shelf therebetween.

5. The safe of claim 1 including a dust cover pivotably disposed over said security mechanism.

6. The safe of claim 1 wherein said pivoting door and said right and left side panels, said top panel, said bottom panel, and said rear panel, each includes a cavity filled with foam insulation.

7. The safe of claim 1 wherein said safe is formed of ABS plastic.

* * * * *